United States Patent [19]

Bennett

[11] 4,439,954

[45] Apr. 3, 1984

[54] SPIN BLAST TOOL

[75] Inventor: Percy J. Bennett, Houston, Tex.

[73] Assignee: Clemtex, Inc., Houston, Tex.

[21] Appl. No.: 336,269

[22] Filed: Dec. 31, 1981

[51] Int. Cl.[3] ..... B24C 3/32; B05B 3/06

[52] U.S. Cl. ..... 51/411; 239/246; 239/251; 15/3.5

[58] Field of Search ..... 51/411, 439; 15/3.5, 15/406; 239/DIG. 13, DIG. 19, 591, 246, 251

[56] References Cited

U.S. PATENT DOCUMENTS

| | | | |
|---|---|---|---|
| 887,935 | 5/1908 | Greenlaw | 415/406 |
| 2,358,557 | 9/1944 | Boyd et al. | 51/411 |
| 2,379,432 | 7/1945 | Heany | 51/439 |
| 2,755,598 | 7/1956 | Denburgh | 51/439 |
| 3,137,974 | 6/1964 | Kirkland | 51/411 |
| 3,902,276 | 9/1975 | Jarvis | 51/411 |
| 3,994,097 | 11/1976 | Lamb | 51/439 |
| 4,080,762 | 3/1978 | Watson | 51/439 |
| 4,181,092 | 1/1980 | Johnson | 51/411 |
| 4,314,427 | 2/1982 | Stoltz | 51/411 |

*Primary Examiner*—Frederick R. Schmidt

*Assistant Examiner*—Robert A. Rose

*Attorney, Agent, or Firm*—David A. Rose; Murray Robinson; Ned L. Conley

[57] ABSTRACT

The spin blast tool includes a housing having a tubular member rotatably disposed on bearings in the housing. A nozzle is mounted on one end of the tubular member and the other end of the tubular member is connected to a pressurized air and sand source. That end of the tubular member adjacent the presurized air and sand source includes a counterbore for receiving a tungsten carbide throat insert. The throat insert has an inner diameter which is smaller than the inner diameter of the tubular member. The insert has an annular radial flange juxtaposed with the end of the pressurized air and sand source. A polyurethane seal washer circumscribes the throat insert and is housed between the radial flange and the end of the tubular member. A wafer spring section is compressed between the outboard surface of the radial flange and the end of the pressurized air and sand conduit. The wafer spring section provides constant pressure on the throat insert as the throat insert wears.

11 Claims, 1 Drawing Figure

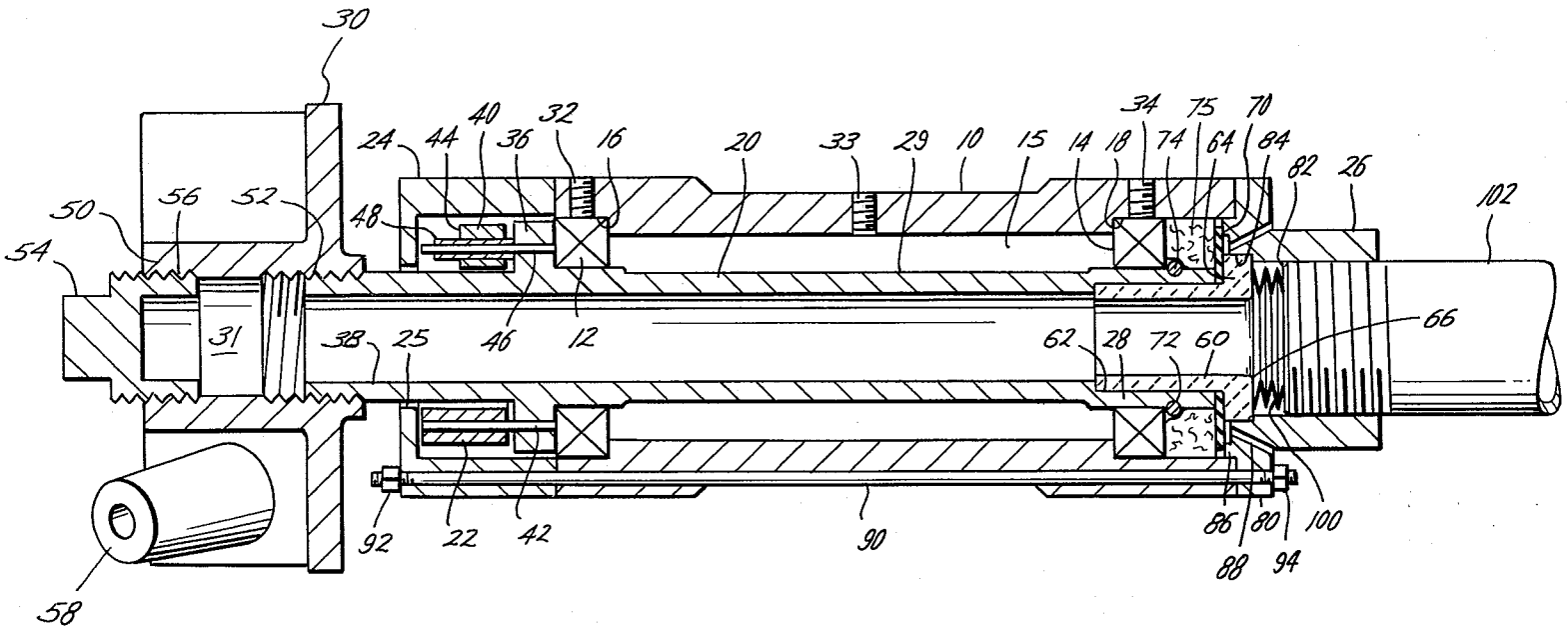
102
66
26
82
84
70
64
75
74
34
18
14
15
10
29
33
20
16
32
36
40
44
24
48
30
52
56
50
54
31
58
100
94
80
86
88
60
72
28
62
90
42
22
92
12
46
25
38

SPIN BLAST TOOL

BACKGROUND OF THE INVENTION

The present invention relates to the art of sand blasting and more particularly to an improved spin blast tool resistant to internal abrasion.

Metal work pieces, such as pipe and castings, require sand blasting for cleaning and treatment. Sand blasting includes projecting a blast or stream of sand and air under pressure onto the metal work piece so that the sand and air mixture impinges on the work piece. The pressurized air and sand abrades and thus cleans the surface of the metal. Sand blast tools generally include a nozzle which directs the pressurized mixture of sand and air onto the surface of the work piece.

It is preferred that the stream of air and sand from the nozzle of the spin blast tool be maintained in motion over the metal surface to be cleaned in order to accomplish a uniform effect. Such spin blast tools are disclosed and described in U.S. Pat. Nos. 2,358,577; 2,724,928; and 3,137,974. Although a single nozzle may be used from which to direct the blast of sand and air toward the work piece, it is generally preferred for the spin blast tool to have a nozzle which provides two streams of air and sand under pressure from a single source to permit covering a larger area in less time than is possible with a single blast nozzle.

For example, U.S. Pat. No. 3,137,974 discloses a rotary cleaning device utilizing a continual swirling action for the abrasive sand to impinge on the work piece. The nozzle has a plurality of blast producing outlets by which the blast of sand emanating therefrom will provide a reactive force which will impart a swirling of the sand blast nozzle as the sand and air stream therefrom. This results in a more uniform distribution of the sand blast and thus avoids pitting and overblasting.

One of the deficiencies of the prior art tools is that not only does the sand abrade the metal of the work piece, it also abrades the interior of the spin blast tool. The spin blast tool is connected to a conduit which supplies the compressed air and sand for the spin blast tool. The interior of the tool is abraded as the air and sand passes through the tool and thereafter out through the nozzle. The passage of sand through the interior of the tool tends to pit, abrade, and otherwise deteriorate the tool, particularly the conduits and rotary connections within the tool. This abrasion causes spin blast tools to have a relatively short life and requires frequent replacement or repair due to the deterioration.

The prior art tools have seals to protect the rotary connections against the abrasive sand. However, these seals deteriorate so quickly that they have to be replaced within a matter of hours; plus, the abrasion and deterioration of the seals limit the usage and life of the sand blast tool.

The continual replacement of seals requires the expenditure of much time and money. Further, damage to the tool, such as the abrasion of rotary connections, may occur if such seals are not promptly replaced.

It is the object of the present invention to overcome this internal abrasion, to substantially extend the life of the metal parts of the tool, and to improve the seals and protection of the rotary connections of the tool. Other objects and advantages of the invention will be apparent from the following description.

SUMMARY OF THE INVENTION

The spin blast tool includes a housing having a tubular member rotatably disposed on bearings in the housing. A nozzle is mounted on one end of the tubular member and the other end of the tubular member is connected to a pressurized air and sand source. That end of the tubular member adjacent the pressurized air and sand source includes a counterbore for receiving a tungsten carbide throat insert. The insert has an inner diameter which is smaller than the internal diameter of the tubular member. The insert also has an annular radial flange juxtaposed with the end of the tubular member. A polyurethane seal washer circumscribes the throat insert and is housed between the radial flange and the end of the tubular member. A wafer spring section is compressed between the outboard surface of the radial flange and the end of the pressurized air and sand cord conduit. The wafer spring section provides constant pressure on the throat insert as the throat insert wears.

BRIEF DESCRIPTION OF THE DRAWINGS

For a detailed description of a preferred embodiment of the invention, reference will now be made to FIG. 1 which is a sectional plan view taken along a vertical plane through the spin blast tool embodying the present invention.

DESCRIPTION OF THE PREFERRED EMBODIMENT

Referring to FIG. 1, there is shown the spin blast tool of the present invention including a body member or housing 10, a front bearing assembly 12, a rear bearing assembly 14, a tubular member or nozzle tube 20, a braking assembly 22, a brake housing 24, a rear closure member 26, and a nozzle 30. Housing 10 includes a front counterbore 16 for receiving front bearing assembly 12 and a rear counterbore 18 for receiving rear bearing assembly 14. A plurality of lubrication ports, threadingly engaging plugs 32, 33, and 34, are provided in the wall of housing 10 for lubricating bearing assemblies 12, 14 and filling annulus 15 with lubricant.

Nozzle tube 20 is a generally cylindrical tubular member, preferably made of brass, having a threaded end 38 and a nonthreaded end 28. Tube 20 is telescopically received within housing 10 by insertion of nonthreaded end 28 through front counterbore 16. Tube 20 has a reduced diameter portion 29 around its mid section to facilitate assembly of tube 20 in bearing assemblies 12, 14. Tube 20 is disposed centrally within housing 10 by bearing assemblies 12, 14 which permit rotation of tube 20 within housing 10. Tube 20 also includes a radial annular flange 36 juxtaposed to front bearing assembly 12 for maintaining bearing assembly 12 within front counterbore 16. Only tube 20 rotates within housing 10.

Brake 22 and governor assembly 40 are telescopically received over the threaded end 38 of tube 20. Brake housing 24 is received over tube 20 by projecting tube 20 through central aperture 25 in housing 24 thereby disposing brake 22 within brake housing 24. Brake 22 is positioned on pin 42 which extends from radial flange 36 of tube 20 and includes a brake lining adapted to engage housing 24. Governor assembly 40 includes a governor control arm 44 positioned on pin 46 and a spring 48 providing a force, in addition to the centrifugal force, to cause a radial outward movement of governor control arm 44. The radial outward movement of governor control arm 44 causes the brake lining of brake 22 to frictionally engage the interior of brake housing 24 and retard and/or regulate the speed of rotation of tube 20 within housing 10.

Nozzle 30 includes a nozzle head 50 of unitary construction having a base plate portion and a tubular portion. The tubular portion includes a bore 31 threaded at both ends. The threads at 52 on threaded end 38 of tube 20 threadingly engage one end of bore 31. A plug 54 is threadingly coupled at 56 to nozzle 30 at the other end of bore 31. A plurality of nozzle orifices 58 are disposed on head 22. Nozzle orifices 58 are coupled to the planar portions of head 50 which have an opening to provide communication between bore 31 and the exterior of head 50. Each nozzle orifice 58 may be lined with a suitable wear-resistent material such a tungsten carbide to insure longer life.

Wear-resistant throat insert 60 is a generally cylindrical member having an integral annular flange 64 at one end. The nonthreaded end 28 of tube 20 includes a counterbore 62 which receives the cylindrical body portion of throat insert 60. The interior mouth 66 of throat insert 60 has a radial edge. Throat insert 60 is made of tungsten carbide which is very wear-resistant to the deterioration effects of the pressurized air and sand. For example, under normal operation, steel will wear in about 4 hours, cast iron in about 8 hours, and heat treated cast iron in about 12 hours, but the tungsten carbide throat insert 60 permits the nozzle tube 20 to have a life of approximately 50 hours. An all tungsten carbide nozzle tube would have a life of around 200 hours but would be prohibitively expensive. Thus the tungsten carbide throat insert 60 substantially increases the life of nozzle tube 20 with a modest increase in expense.

This increase in nozzle tube life is also due to the design of throat insert 60. The internal diameter of throat insert 60 is at least equal to and preferably smaller than the internal diameter of tube 20. Since the pressurized air and sand is in laminar flow as it passes through nozzle tube 20, the mouth 66 of insert 60 directs the flow into a smaller laminar flow stream through tube 20 so as to limit the contact of the air and sand stream with the interior of tube 20. Thus, the abrasive and deterioration effect of the sand and air is substantially reduced. Further the annular flange 64 has a thickness of ¼ inch, approximately four times as great as the tube thickness of 1/16 inch of throat insert 60 so that flange 64 will have a greater wear thickness.

An annular semi-circular snap ring groove 72 is disposed around the periphery of the nonthreaded end 28 of tube 20 so as to be adjacent rear bearing assembly 14. Snap ring 74 is housed in groove 72 to retain tube 20 in housing 10 as thrust is applied to tube 20 by the pressurized air and sand from conduit 102. Snap ring 74 also maintains rear bearing assembly 14 in position. A bearing seal 75 made of leather is provided around nonthreaded end 28 as a backup seal to bearing assembly 14. A seal gasket 70, made of polyurethane, circumscribes throat insert 60 and is juxtaposed between the interior annular surface of flange 64 and bearing seal 75. As throat insert 60 is received within counterbore 62, seal gasket 70 is compressed between annular flange 64 and nonthreaded end 28 of tubular member 20. The outer radial edge of seal 70 is captured between bearing seal 75 and closure member 26. Seal 70 serves to keep abrasive material from entering the main body of housing 10 and causing damage to the component parts inside housing 10. Seal 70 is also self-lubricating. Prior art leather seals had to be lubricated. Seal 70 has a life of 6–10 times longer than leather seals. Bearing seal 75 serves as a backup dust seal for bearing assembly 14.

Prior art seals are located at the juncture between the end of the nozzle tube and the rear end of the housing. This permits the pressurized air and sand to directly contact and quickly deteriorate the seal. In the present invention, a close fit of 3 to 5 thousandths is maintained between the outside diameter of throat insert 60 and the inside diameter of tube 20. By locating seal 70 around throat insert 60 and maintaining a close fit between insert 60 and tube 20, air and sand must pass through insert 60, around the tube end of insert 60, between the outside of insert 60 and the wall of counterbore 62 of tube 20 before the air and sand can deteriorate seal 70. This greatly increases the protection of seal 70 and substantially enhances its life. Further, air and sand must pass seal 70 and backup bearing seal 75 to reach rear bearing assembly 14.

Rear closure member 26 includes an annular flange 80 and a threaded bore 82. Bore 82 has a counterbore 84 adjacent flange 80 for matingly receiving annular flange 64 of throat insert 60. Annular flange 80 includes an axially projecting annular flange 86 which is matingly received within rear counterbore 18 of housing 10 for engagement with the peripheral edge of seal 70. Rear closure member 26 also includes a plurality of relief bores 88 for inspection of potential damage to seal 70.

A plurality of longitudinal coaxial bores extend through brake housing 24, housing 10 and closure member 26 for receiving pins 90 threaded at each end for engagement with front and rear nuts 92, 94 to assemble the tool.

A wafer spring section 100 is received within threaded bore 82 of closure member 26 to engage annular flange 64 of throat insert 60. Air and sand conduit 102 is then threadingly engaged with closure 26 to compress wafer spring section 100. Wafer spring section 100 maintains pressure on flange 64 of throat insert 60 and thus on polyurethane dust seal 70 as wear progresses during the operation of the spin blast tool. This constant pressure through spring compression results in a greater seal life for seal 70.

In operation, a mixture of air and sand under pressure is supplied to the spin blast tool through conduit 102. The pressurized mixture first impinges on the radial edge of mouth 66 of insert 60 and thus is directed through insert 60. Since annular flange 64 sustains most of the wear of insert 60, wafer spring section 100 bears on flange 64, as mouth 66 and flange 64 wears, to maintain sealing engagement of seal 70 between the end of tube 20 and the interior side of flange 64. The pressurized air and sand passes through insert 60 in laminar flow. Since the internal diameter of insert 60 is smaller than the internal diameter of tube 20, the flow stream also has a diameter smaller than the inner diameter of tube 20, thus substantially reducing contact with the interior of tube 20. This minimum contact reduces substantially the wear of nozzle tube 20. Substantially all of the impact of the pressurized air and sand is received by plug 54 in nozzle 30 at the end of tube 20. Plug 54 has a cavity where sand becomes collected such that the collected sand receives the brunt of the impact of the projected stream through the sand blast tool prior to being channeled through and outward of nozzles 58.

While a preferred embodiment of the invention has been shown and described, modifications thereof can be made by one skilled in the art without departing from the spirit of the invention.

I claim:

1. A sand blast tool comprising:

a body member having an aperture therethrough;

a conduit rotatably mounted within said aperture and having a bore therethrough;

a nozzle mounted on one end of said conduit;

said body member having connection means adapted for connecting said body member to a source of pressurized air and sand;

said conduit having its other end adjacent said connection means for receiving the pressurized air and sand;

a wear insert having a tubular body and a radial flange;

said other end of said conduit having a counterbore;

said tubular body received within said counterbore of said other end of said conduit and in rotating engagement therewith;

said radial flange extending around said other end;

sealing means disposed between said radial flange and said other end of said conduit;

said tubular body having an inner diameter smaller than the inner diameter of said conduit and being made of a material more wear-resistant than the material of said conduit whereby said wear insert directs the stream of pressurized air and sand away from the internal surface of said bore and encounters the initial entry of said pressurized air and sand into said conduit.

2. The sand blast tool of claim 1 wherein said radial flange is housed between said other end of said conduit and the pressurized air and sand source, said radial flange forming a rounded annular edge with said tubular body and having a thickness at least twice as great as the thickness of the wall of said tubular body whereby the pressurized air and sand is guided into said wear insert and said flange can withstand substantial wear prior to replacement.

3. The sand blast tool of claim 1 wherein said sealing means includes a polyurethane seal disposed between said radial flange and said other end of said conduit.

4. The sand blast tool of claim 3 further including spring means for compressing said polyurethane seal between said flange and said other end as said flange wears.

5. The sand blast tool of claims 1, and 2 wherein said wear insert is made of tungsten carbide.

6. The sand blast tool of claims 1, and 2 further including spring means for biasing said wear insert against said conduit.

7. The sand blast tool of claim 1 further including a self-lubricating leather seal disposed between said seal and said other end of said conduit.

8. The spin blast tool of claim 2 further including a self-lubricating leather seal disposed between said seal and said other end of said conduit.

9. The spin blast tool of claim 3 further including a self-lubricating leather seal disposed between said polyurethane seal and said other end of said conduit.

10. A spin blast tool for treating the metal surface of a work, comprising:

a body member having an aperture therethrough and a closure member at one end;

a tube rotatably mounted within said aperture and having a bore therethrough;

a nozzle mounted on one end of said tube;

said closure member having connection means for connecting said closure member with a source of pressurized air and sand;

a wear-resistant throat including a conduit having a radial flange at one end thereof, said throat being made of tungsten carbide, said conduit having an inner diameter smaller than the internal diameter of said bore and a length less than one half the length of said tube, said conduit being substantially all received in a counterbore in the other end of said tube whereby said throat and tube have a substantial contact area for said throat to act as a shield to the pressurized air and sand;

a polyurethane seal washer circumscribing said throat and being disposed between said other end of said tube and said radial flange, said washer sealingly engaging said tube and throat; and biasing means engaging said radial flange for biasing said seal washer between said other end of said tube and said radial flange as said throat wears.

11. A spin blast tool for treating a metal surface, comprising:

a body member including a tubular portion, a brake housing, and a closure cap, said brake housing and closure cap being mounted on each end of said tubular portion with a common aperture extending therethrough;

a conduit received within said common aperture and rotatably mounted by bearing means within said tubular portion;

a nozzle disposed on one end of said conduit providing communication between the bore of said conduit and the orifice of said nozzle;

brake means disposed in said brake housing for adjusting the speed of rotation of said conduit;

governor means for controlling the speed of rotation of said brake means;

a tungsten carbide insert in rotating engagement with a counterbore in the other end of said conduit, said insert having an inner diameter smaller than the internal diameter of said conduit, said insert having an annular radial flange;

a polyurethane dust seal circumscribing said insert and disposed between said other end and said radial flange; and means for biasing said insert towards said dust seal to maintain said dust seal in sealing engagement between said conduit and insert.

* * * * *